United States Patent [19]

Beeker et al.

[11] 4,195,571

[45] Apr. 1, 1980

[54] MODULAR WHEEL DISPENSER

[75] Inventors: Charles W. Beeker; William J. Pribyl, Jr., both of Baltimore, Md.

[73] Assignee: The United States of America as represented by the Secretary of the Army, Washington, D.C.

[21] Appl. No.: 26,374

[22] Filed: Apr. 2, 1979

[51] Int. Cl.[2] ..... F42B 13/56

[52] U.S. Cl. ..... 102/89 CD; 102/7.2

[58] Field of Search ..... 102/89 CD, 7.2, 92.4, 102/92.6; 343/18 B, 18 E

[56] References Cited

U.S. PATENT DOCUMENTS

| | | | |
|---|---|---|---|
| 3,143,965 | 8/1964 | La Pointe | 102/89 CD |
| 3,308,759 | 3/1967 | Sorenson | 102/89 CD |
| 3,626,415 | 12/1971 | Montgomery | 102/89 CD |
| 3,674,174 | 7/1972 | Crewe | 102/89 CD |
| 3,726,223 | 4/1973 | Moe | 102/7.2 |
| 3,837,278 | 9/1974 | Gustafsson et al. | 102/89 |
| 3,899,975 | 8/1975 | Laurence | 102/89 CD |

*Primary Examiner*—Harold J. Tudor

*Attorney, Agent, or Firm*—Nathan Edelberg; Robert P. Gibson; Harold H. Card, Jr.

[57] ABSTRACT

Rapid aerial dispersion of thin metallic strips or chaff to confuse enemy radar is achieved by packaging the chaff in multiple resilient wheels within a tubular container. Upon aerial release of the container, the wheels separate from each other and spin off randomly, scattering chaff over a wide area without local concentrations or bird-nesting within such area.

5 Claims, 7 Drawing Figures

MODULAR WHEEL DISPENSER

DEDICATORY CLAUSE

This invention can be used and made by the United States Government without the payment of royalties thereon.

BACKGROUND OF THE INVENTION

Dispersal of chaff to divert enemy gunfire and missiles away from friendly aircraft by confusing enemy target acquisition or radar tracking devices is well known in the prior art. While numerous materials are suitable for this purpose, chaff may be generally said to comprise a multitude of discrete particles or separate masses, usually metallic or metallic coated, in various forms such as powder, thin strips, fibers, chips, and the like.

When radar techniques were relatively new and unlike the complex sophisticated target seeking and aiming systems in modern use, methods for dissemination of chaff were commensurately unsophisticated, such as manually dispensing chaff through openings in the crew compartments of an aircraft. Later, hand dispensing progressed to mechanical dispensing, then to forcible ejectors of various forms and finally to pyrotechnic ejectors. These advances paralleled the improvements in radar systems as they became increasingly more accurate and effective. Despite the advances thus far made in chaff dispensing techniques and devices, certain problems remain. Thus, it is necessary in order to conceal a large target and avoid discrimination by enemy radar between real targets and false targets, that large mass distribution of chaff be made quickly when a combat threat occurs. Prior art methods of accomplishing this objective usually involve mass dumping procedures whereby large bulks of closely packed chaff are rapidly ejected in the expectation that natural acceleration and aerodynamic forces will disentangle and scatter the discrete elements comprising the chaff. That expectation is as likely to be disappointed as to be realized in actual experience. The occurrence of severe clumping or "birdnesting" of chaff, especially the type comprising elongate strips, is familiar to those working in this field of technology. Where chaff elements do not scatter over a sufficiently wide area, the close proximity of dipole to dipole in chaff concentration results in a severe compromise of effectiveness which could endanger the actual target by exposure to enemy radar tracking or homing devices.

SUMMARY OF THE INVENTION

The invention in this case comprises a container 12 having a plurality of individual wheels 22 restrained therein. Each of the wheels 22 is formed with a series of compartments 24, these being filled with compressed chaff. Container 12 has a pyrotechnic system 16 adapted to eject wheels 22 when the ejection system is activated. Upon ejection, wheels 22 deform into arcuate segments or flat strips whereby the chaff in thin pockets 24 is no longer compressed and is forcibly released from each of the wheels.

DETAILED DESCRIPTION OF A PREFERRED EMBODIMENT

Figure 2:
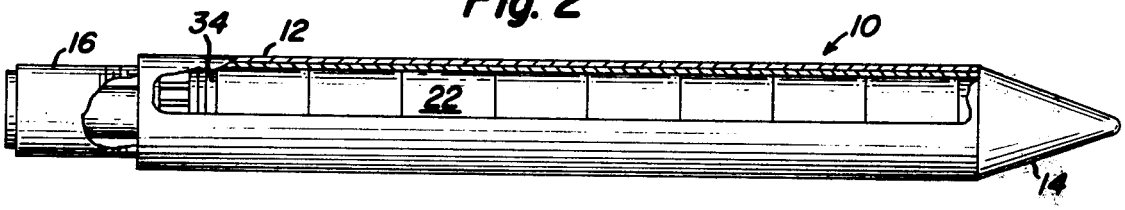
FIG. 2 shows a side elevational view, partly in cross-section, of the structure in FIG. 1 when fully assembled prior to operation.

Referring to FIG. 2, the invention comprises a dispensing system generally designated by reference numeral 10 and including a container 12, preferably of elongate form such as the hollow tube or cylinder shown, having a closure cap 14 or ogive or conical shape at one end of tube 12 and force actuation means 16 at the other end thereof. Container 12 could be made from a wide variety of materials such as metal, rigid plastic, reinforced fiberglass, paper fiber or the like, provided that tube 12 has sufficient strength and rigidity to resist deformation under acceleration forces to which it may be subjected. These will vary depending upon such factors as whether tube 12 will be dropped from an aircraft, fired from a cannon, and so forth. If fired from a cannon, acceleration forces as much as 20 Gs are not uncommon.

Figure 3:
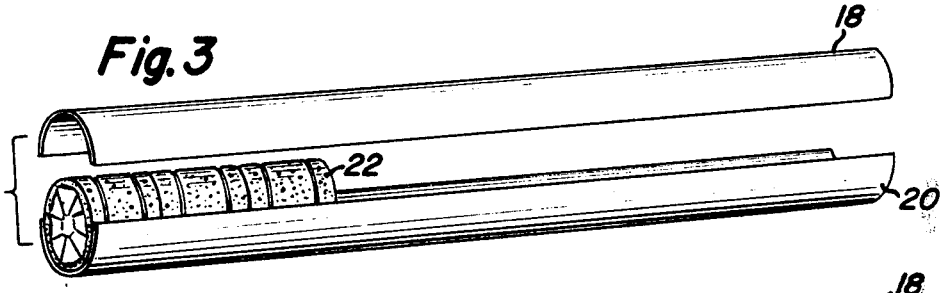
FIG. 3 shows a perspective view of certain internal components from the structure in FIG. 2 during assembly.
Figure 4:
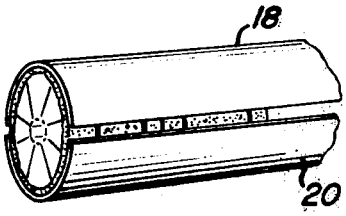
FIG. 4 shows a perspective view of the structure in FIG. 3 after assembly.

Dispensing system 10 further comprises segments restraining means such as a split sleeve consisting of semicylindrical sections 18 and 20 seen in FIG. 3, for example. When assembled as in FIG. 4, sections 18 and 20 form a cylinder which is sized and arranged to fit coaxially within container 12 and to make substantially uniform surface area contact between the inner surface of the container and the outer surfaces of sections 18 and 20 so that both sections are held in the operative relationship shown in FIG. 2 by the rigid walls of hollow tubular container 12.

Within the hollow interior of the split sleeve formed by sections 18 and 20, a plurality of disc or substantially wheel-shaped elements 22 are arranged in closely abutting relationship and coaxially about the longitudinal axis of the cylinders formed by sections 18, 20 and by tube 12. Wheels 22 essentially comprise a succession of integrally formed individual adjoining wedge-shaped pockets or compartments 24 whereby the wheel is preferably of unitary construction. While the precise number of pockets 24 may vary from a minimum of two on up to 12 or more, and may depend upon the form of chaff to be dispensed, the perferred embodiment contains eight as shown.

Figure 5:
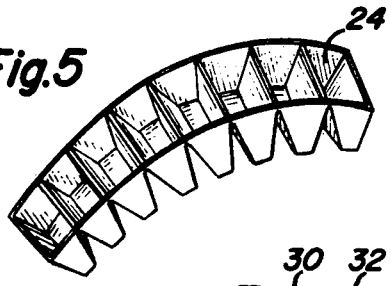
FIG. 5 shows a perspective view of a component part in the subassembly shown in FIGS. 3 and 4.
Figure 7:
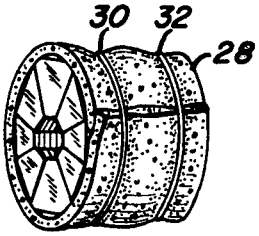
FIG. 6 shows a perspective view of an internal component including the structure of FIG. 5 during an intermediate stage of assembly and FIG. 7 shows the component of FIG. 6 fully assembled and ready for assembly in the structure shown by FIGS. 1 through 4.

The materials of construction for wheels 22 may vary widely, but vacuum formed plastic offers several advantages and is preferred. It is economical for mass production use, and if formed in flat strips including the slightly arcuate configuration seen in FIG. 5, and thereafter forcibly deformed into circular shape (FIG. 6), its resiliency will result in spontaneous return to its unrestrained static shape upon release of the restraints used to hold it in circular condition. Deformation on the strip material will result in wedge-shaped pockets 24 being radially disposed about the center axis of wheels 22. Where wheels 22 are initially molded in circular form without the benefit of resiliency, appropriate materials might include steel, fiberglass, or aluminum, and such fabrication processes as blow-molding, die-molding or stamping.

Figure 6:
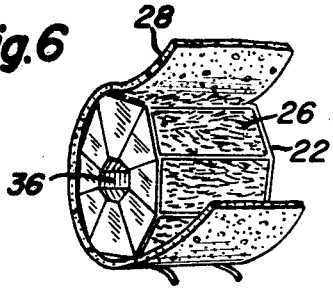

As seen in FIG. 6, each of the compartments 24 is packed with chaff 26 which is held under compression therein by suitable holding means such as wrapping element 28 which may be made from various materials but in the preferred embodiment is foamed plastic sheet material constrained by such readily available means as rubber bands 30 and 32.

Figure 1:
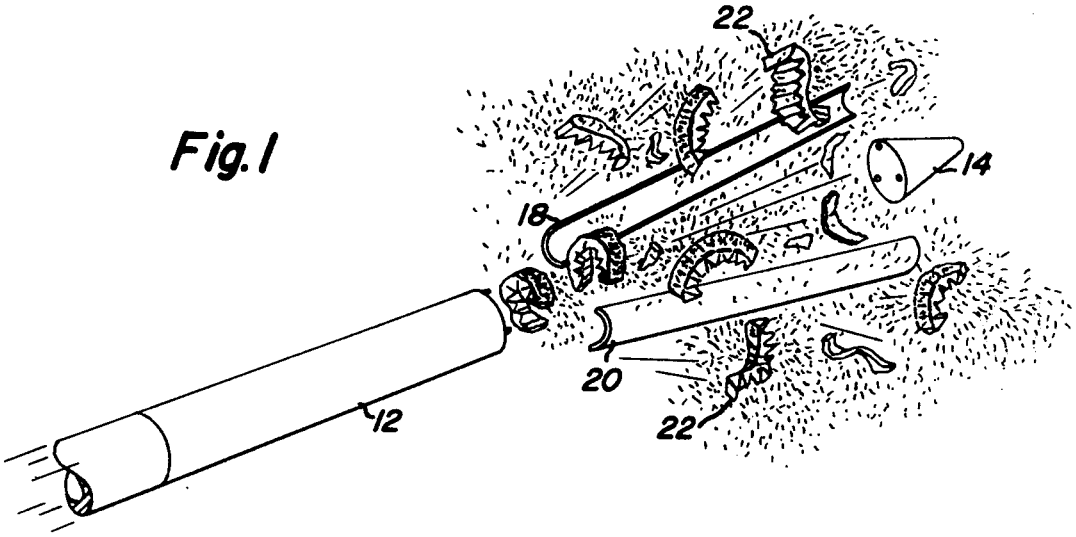
FIG. 1 shows a general perspective view of the inventive structure in operation.

Referring again to FIG. 2, dispensing system 10 includes ejection means of conventional type such as pyrotechnic device 16 secured to the aft end of tube 12 and adapted to eject wheels 22 upon detonation by conventional means (not shown). Upon detonation of item 16, gas pressure is applied to force-transmitting means such as pusher pads 34 which displace forwardly, applying force to the wheel stack formed by wheels 22 and sections 18, 20 causing ejection of these elements plus nose cone 14 from within container 12 in the manner shown by FIG. 1.

The invention in this case further contemplates the optional use of force from within hollow center area 36 within wheels 22 to cause abrupt deformation of the wheels at the time they separate from sections 18, 20. Thus, some of the gas pressure from ejection means 16 may enter within area 36 when means 16 is detonated, such as to deform the wheels from circular to other shapes as suggested in FIG. 1. This added force is not essential where wheels 22 are made of resilient material and forcibly deformed from substantially flat or shallow arcuate strips into circular shape as discussed above. Release of sections 18, 20 by detonation of ejector 16 will necessarily cause the resilient wheels to deform when the restraints holding them in circular form are released.

The structure disclosed hereinabove has been found much superior to prior art means for dispensing chaff. The efficient dissemination of chaff depends directly upon the quantity being dispensed and the method of packing the chaff prior to dissemination. Where the chaff is of substantial bulk and is dispensed in large bulks, clumping of chaff in high density concentrations severely compromises its effectiveness as an electronic countermeasure against enemy radar. Maximum effectiveness requires the separation of each dipole to reflect the radio frequency of the radar signal back to its source. The effectiveness of this invention results from the fact that large bulks of chaff material are separated into small individual packets which break up easily upon release from container 12 and tumble randomly in all directions, throwing chaff rapidly over a wide area without local density concentrations in the pattern of distribution thus achieved. Also, the cylindrical form of tube 12 adapts this structure to a wide range of launching applications including rockets, shells, missiles, and cluster munitions.

We claim:

1. A dispensing system for electronic countermeasure against enemy aiming devices, said system comprising:

an elongate hollow housing, a plurality of substantially wheel-shaped elements each having at least two compartments formed therein, said wheel-shaped elements being resiliently deformed and coaxially aligned within said hollow housing, said wheel-shaped elements are resiliently deformable from elongate strips into substantially circular condition and are restrained in said condition within said hollow housing so that, upon release therefrom, said wheel-shaped elements spontaneously resume their elongate strip configuration.

chaff material contained in each of said compartments, and forcible ejection means secured to said hollow housing so that actuation of said ejection means applies force to eject said wheel-shaped elements out of said hollow housing.

2. The structure set forth in claim 1, wherein:

said forcible ejection means comprises a pyrotechnic device adapted to generate gas under pressure for displacing said wheel-shaped elements out of said hollow housing.

3. The structure set forth in claim 2, wherein:

said wheel-shaped elements have a plurality of said compartments integrally adjoining each other whereby said wheel-shaped elements are of integral construction.

4. A dispensing system for electronic countermeasure against enemy radar, consisting of:

an elongate cylindrical housing having a forward end and an aft end, a conical closure cap on said forward end, a split sleeve comprising a plurality of segments adapted to form a cylinder concentric within said cylindrical housing, a plurality of substantially cylindrical wheels abutting each other and coaxially aligned within said split sleeve, each of said wheels having a plurality of wedge-shaped pockets radially disposed about the center thereof and integrally formed with each other of said pockets, said wheel-shaped elements are resiliently deformable from elongate strips into substantially circular condition and are restrained in said condition within said hollow housing so that, upon release therefrom, said wheel-shaped elements spontaneously resume their elongate strip configuration.

chaff material in each of said pockets, and pyrotechnic ejector means on said aft end of said housing for ejecting said wheels and said split sleeve from said housing to dispense said chaff material.

5. A method of dispensing chaff, comprising:

deforming a substantially flat resilient strip of material containing pockets into a circular shape, loading chaff material into said pockets, compressing said resilient strip in said circular shape within a container, and releasing said circular shaped strip from the confines of said container whereby said resilient strip assumes its substantially flat condition and forcibly dispenses said chaff randomly in all directions.

* * * * *